US008277286B2

(12) United States Patent
Hung et al.

(10) Patent No.: US 8,277,286 B2
(45) Date of Patent: Oct. 2, 2012

(54) SLURRY DISPENSER FOR CHEMICAL MECHANICAL POLISHING (CMP) APPARATUS AND METHOD

(75) Inventors: Kun-Ku Hung, Hemei Township, Changhua County (TW); Zin-Chang Wei, Hsin-Chu (TW); Huang Soon Kang, Hsin Chu (TW); Chyi-Shyuan Chern, Taipei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 751 days.

(21) Appl. No.: 12/370,662

(22) Filed: Feb. 13, 2009

(65) Prior Publication Data

US 2010/0210189 A1 Aug. 19, 2010

(51) Int. Cl.

| | |
|---|---|
| ***B24B 1/00*** | (2006.01) |
| ***B24B 57/02*** | (2006.01) |
| ***B24B 29/00*** | (2006.01) |

(52) U.S. Cl. ..... 451/60; 451/287; 451/446

(58) Field of Classification Search ..... 451/60, 451/287, 446

See application file for complete search history.

(56) References Cited

U.S. PATENT DOCUMENTS

| | | | | |
|---|---|---|---|---|
| 2,380,275 | A * | 7/1945 | Turner et al. | 451/60 |
| 6,116,993 | A * | 9/2000 | Tanaka | 451/287 |
| 6,338,669 | B1 * | 1/2002 | Togawa et al. | 451/60 |
| 6,361,647 | B1 * | 3/2002 | Halley | 156/345.1 |
| 6,398,627 | B1 | 6/2002 | Chiou et al. | |
| 6,503,126 | B1 * | 1/2003 | Rhoades | 451/60 |
| 6,679,765 | B2 * | 1/2004 | Tung et al. | 451/60 |
| 7,387,222 | B2 | 6/2008 | Thompson et al. | |

OTHER PUBLICATIONS

SIPO Office Action dated Mar. 5, 2012, In Chinese, USP 6,116,993; 6,361,647 and 2,380,275 already cited.

* cited by examiner

*Primary Examiner* — Hadi Shakeri
(74) *Attorney, Agent, or Firm* — Duane Morris LLP

(57) ABSTRACT

A chemical mechanical polishing method and apparatus provides a deformable, telescoping slurry dispenser arm coupled to a dispenser head that may be arcuate in shape and may also be a bendable telescoping member that can be adjusted to vary the number of slurry dispenser ports and the degree of curvature of the dispenser head. The dispenser arm may additionally include slurry dispenser ports therein. The dispenser arm may advantageously be formed of a plurality of nested tubes that are slidable with respect to one another. The adjustable dispenser arm may pivot about a pivot point and can be variously positioned to accommodate different sized polishing pads used to polish substrates of different dimensions and the bendable, telescoping slurry dispenser arm and dispenser head provide uniform slurry distribution to any of various wafer polishing locations, effective slurry usage and uniform polishing profiles in each case.

19 Claims, 9 Drawing Sheets

SLURRY DISPENSER FOR CHEMICAL MECHANICAL POLISHING (CMP) APPARATUS AND METHOD

FIELD OF THE INVENTION

The present invention relates, most generally, to semiconductor device manufacturing. More particularly, the present invention relates to an apparatus and methods for chemical mechanical polishing of semiconductor substrates using an adjustable slurry dispenser arm.

BACKGROUND

In today's rapidly advancing semiconductor manufacturing industry, chemical mechanical polishing (CMP) is an advantageous and favored way of planarizing and polishing semiconductor substrates to remove excess materials from over a surface of the semiconductor substrate. In this manner, damascene techniques may be used to form conductive features within openings such as trenches, vias or contacts formed in insulating layers. In damascene processing, a bulk material such as a conductive material is formed over an insulating layer and within such openings formed within the insulating layer, then removed from over the top surface of the insulating layer using chemical mechanical polishing. The resulting structure includes the conductive materials filling the various openings and extending up to the top surface of the insulating layer after the excess conductive materials have been removed from over the top of the insulating layer.

Chemical mechanical polishing involves a polishing pad and includes mechanical and chemical components. The polishing pad rotates and the wafer surface desired to be polished is brought into contact with the rotating polishing pad at a wafer polishing location. The wafer also rotates to enhance polishing. At a second, dispense, location, a dispenser head dispenses a polishing slurry onto the polishing pad. It is desired for the slurry, dispensed onto the polishing pad at the dispense location, to be delivered uniformly to the wafer polishing location so that the polishing pad has a uniform distribution of slurry thereon at the wafer polishing location.

The polishing slurry is a liquid containing a suspended abrasive component and various chemicals. The mechanical aspect of chemical mechanical polishing (CMP) is the physical abrasion of the semiconductor substrate surface by contact with the polishing pad and the abrasives in the slurry. The chemical component includes one or more chemicals in the slurry that selectively react with the material being removed by CMP. It is clearly critical that the slurry dispensed onto the polishing pad is delivered to the wafer polishing location of the polishing pad, i.e. it is important that the slurry, dispensed at a dispense location, does not spin off the polishing pad such that it never reaches the location where the wafer is being polished. This would be an ineffective usage of the slurry and would significantly decrease the polishing efficiency of the CMP tool. Furthermore, if the slurry is not continuously delivered to the entire wafer polishing location, problems such as a poor polishing profile (non-uniformity) within a wafer and wafer-to-wafer polishing inconsistencies, can ensue.

One challenging aspect of the rapidly advancing semiconductor manufacturing industry is that wafer sizes continue to increase. Many CMP tools that were designed for wafers having diameters of 300 mm are now being used to process wafers that have greater diameters such as diameters of 450 millimeters. As a first matter, it is a general principle that within-wafer and wafer-to-wafer uniformity for 450 mm wafers is more difficult to achieve than for smaller wafer sizes. As a second matter, conventional CMP tools have a fixed slurry dispenser head that may not be able to deliver the slurry to the wafer polishing location on the polishing pad using desirable polishing parameters such as the spin speed of the polishing pad. As a third matter, larger polishing pads are typically used for larger wafers, i.e., a larger polishing pad is advantageously used for a 450 mm wafer than a 300 mm wafer, further changing the dynamics of slurry delivery.

FIGS. 1A and 1B show top and side views, respectively, of aspects of a conventional CMP polishing tool. Polishing pad 1 includes grooves 3 within polishing surface 15 and rotates along direction indicated by arrow 5. Fixed dispenser arm 7 includes a dispenser head 11 at dispense location 9.

FIGS. 2A and 2B illustrate some shortcomings of conventional CMP polishing tools. FIG. 2A shows polishing pad 1 with polishing surface 15 rotating in direction 5 and shows slurry 21 dispensed from dispenser head 7 at dispense location 9. In the arrangement illustrated in FIG. 2A, polishing pad 1 includes a first diameter and includes wafer 19 having a diameter of 300 millimeters positioned on polishing pad 1. Polishing pad 1 may include a diameter of about 725-775 mm in the illustrated example. In the arrangement illustrated in FIG. 2A, it can be seen that slurry 21 is successfully delivered to the polishing location of wafer 19. When a larger pad is used in the same CMP tool having the same dispenser arm, the undesirable result is illustrated in FIG. 2B.

In FIG. 2B, the same CMP tool as in FIG. 2A, with the same dispenser arm is used for polishing a larger substrate. Larger wafer 20 may be a semiconductor wafer having a diameter of about 450 millimeters. In order to accommodate the larger substrate size, larger polishing pad 2 is used. Larger polishing pad 2 may include a diameter of about 900 mm to about 1100 mm. Larger polishing pad 2 also rotates along the direction indicated by arrow 5 and it can be seen that very little slurry 21 dispensed from dispense location 9 of dispenser arm 7 reaches the location of larger wafer 20 on larger polishing pad 2. In this example, slurry 21 is whisked off larger polishing pad 2 due to rotation, before reaching the portion of polishing pad 2 where larger wafer 20 is being polished and this will necessarily result in non-uniformities in the polishing rate across larger wafer 20. As such, when a wafer size is increased from 300 mm to 450 mm and the polishing pad is increased in size correspondingly, if the same slurry dispense location is maintained, the slurry dispense would not be effective due to poor distribution of slurry on the polishing pad. Much of slurry 21 is wasted and is expelled off of the polishing pad before slurry 21 reaches the wafer.

With the cost of CMP tools being excessive, it would be economically undesirable to have dedicated CMP tools for various substrate sizes and polishing pad sizes.

It would therefore be desirable to address the above-identified shortcomings and limitations of conventional CMP polishing operations and tools.

SUMMARY OF THE INVENTION

To address these and other needs and in view of its purposes, the present invention provides, according to one aspect, a chemical mechanical polishing (CMP) apparatus comprising a polishing pad and a slurry dispenser that dispenses slurry onto the polishing pad. The slurry dispenser comprises a dispenser arm coupled to an arcuate dispenser head having a plurality of dispense ports therein. The dispenser arm is a telescoping arm that is pivotable about a pivot point. The dispenser arm is also deformable and capable of retaining a deformed configuration.

According to another aspect, provided is a chemical mechanical polishing (CMP) apparatus comprising a polishing pad and a slurry dispenser that dispenses slurry onto the polishing pad. The slurry dispenser comprises a dispenser arm coupled to a dispenser head having a plurality of dispense ports therein. The dispenser arm is a telescoping and deformable arm that is pivotable about a pivot point and the dispenser head is a telescoping and deformable tubular member.

According to another aspect, provided is a method for chemical mechanical polishing (CMP) of semiconductor wafers. The method comprises providing a CMP apparatus comprising a polishing pad and a slurry dispenser with a dispenser arm having a first configuration, and a dispenser head. The method further comprises providing a first wafer on the polishing pad and dispensing slurry with the dispenser head at a first dispense location, and moving the dispenser head to a second location different than the first location by at least one of expanding, collapsing and bending the dispenser arm to produce a second configuration. The method further comprises providing a second wafer on the polishing pad or a further polishing pad, and polishing the second wafer using slurry dispensed from the dispenser head at the second location.

BRIEF DESCRIPTION OF THE DRAWING

The present invention is best understood from the following detailed description when read in conjunction with the accompanying drawing. It is emphasized that, according to common practice, the various features of the drawing are not necessarily to scale. On the contrary, the dimensions of the various features are arbitrarily expanded or reduced for clarity. Like numerals denote like features throughout the specification and drawing.

DETAILED DESCRIPTION

The present invention is directed to a chemical mechanical polishing apparatus and method. One aspect of the invention is an adjustable slurry dispense location by an repositionable dispenser arm that accommodates the different sized polishing pads used to polish variously sized semiconductor substrates, also known as wafers. Also provided is an adjustable slurry dispense head that can be increased or decreased in size, changed in shape and/or can increase or decrease the number of dispense ports available at the dispenser head. The novel slurry dispenser apparatus provides uniform slurry distribution at the wafer polishing location on the polishing pad to provide effective slurry usage and a uniform polishing profile.

The dispenser arm, according to one exemplary embodiment, is a telescoping member, i.e. the dispenser arm can be expanded or collapsed to vary its length and to therefore vary the radial dispense location on the polishing pad. The dispenser arm is also deformable, i.e. bendable. According to one exemplary embodiment, the dispenser arm is formed of a bendable tube consisting of a plurality of nested tube portions. The bendable tube portion is constructed from a flexible, resilient material that may be repeatedly and forcibly deformed. A deformable stiffening element is included on or in the tube and is constructed of a material that allows it to be repeatedly and forcibly deformed whilst substantially retaining such deformed configuration after the removal of a deforming force. Exemplary materials include metal wires and wire mesh.

The dispenser head, coupled to the dispenser arm, is also a telescoping member and may be similarly bendable in various exemplary embodiments.

Figure 3:
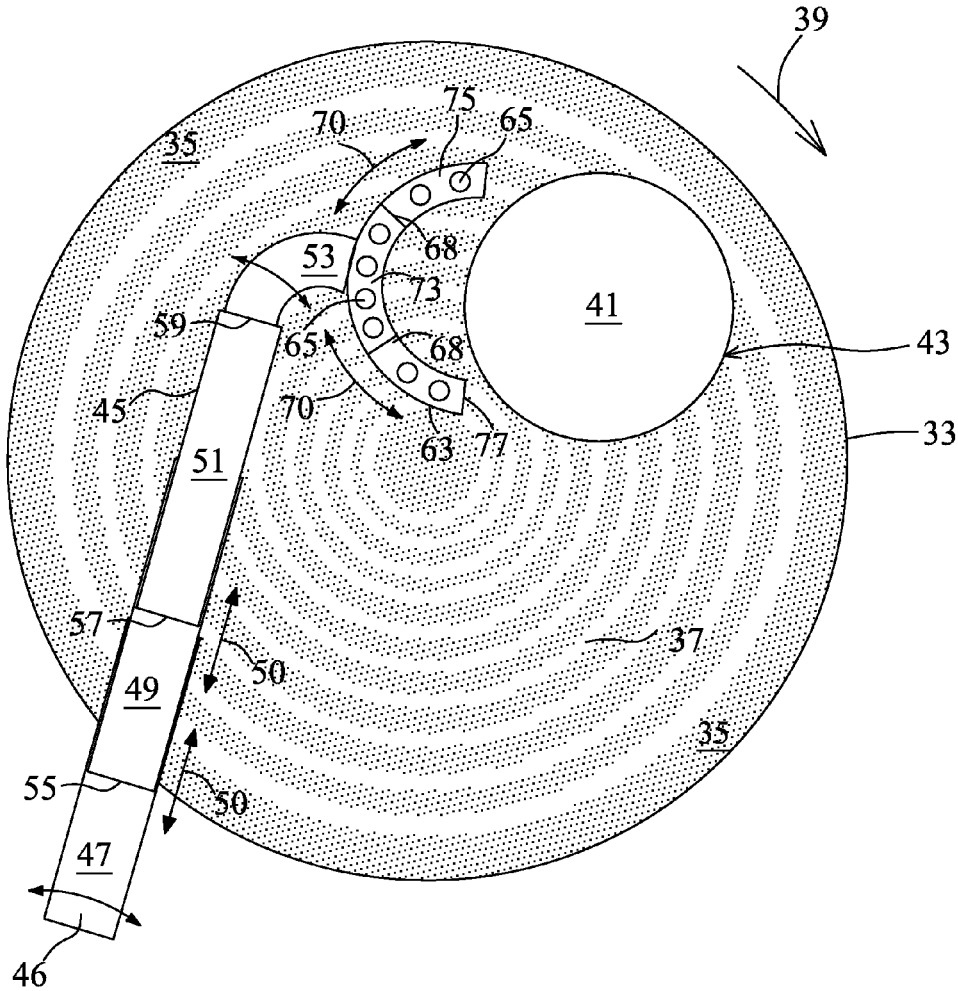
FIG. 3 is a plan view showing an exemplary embodiment of a CMP apparatus according to one aspect of the invention.

Now referring to the figures, FIG. 3 is a plan view showing polishing pad 33, dispenser arm 45 and dispenser head 63 of a CMP apparatus according to one aspect of the invention. Polishing pad 33 includes polishing surface 35 and grooves 37 for retaining slurry. Polishing pad 33 includes a diameter that may range from 500 mm to 1500 mm and may advantageously about 750 mm or 1000 mm. Polishing pad 33 advantageously rotates along clockwise direction 39. Wafer outline 41 represents the outline of a wafer positioned at polishing location 43. Although not illustrated, the wafer is held securely in place against polishing pad 33 by a retaining member that holds the wafer in position and supplies a force urging the wafer against surface 35 of polishing pad 33.

Dispenser arm 45 is pivotable about pivot point 46 and is also a telescoping arm, i.e. dispenser arm 45 can be made longer or shorter by reducing the length of its parts. Dispenser arm 45 is made up of exemplary arm segments 47, 49, 51 and 53 and these segments are slidably nested within one another to enable expansion or contraction of telescoping arm 45 along the direction indicated by arrows 50. Although dispenser arm 45 is illustrated to include four arm segments 47, 49, 51 and 53, such is exemplary only and there may be fewer or greater than four arm segments in other exemplary embodiments. Each of arm segments 47, 49, 51 and 53 is slidably received in the adjacent arm segment such as at intersections 55, 57 and 59. Dispenser arm 45 may be expanded or contracted to provide various lengths. One or all of arm segments 47, 49, 51 and 53 may be bendable, i.e. deformable, responsive to a deforming force and capable of retaining its deformed shape after the deforming force is removed. For example, in the illustrated embodiment, arm segment 53 is shown to be curved while arm segments 47, 49 and 51 are substantially straight but it can be understood that arm segment 53 can be bent and can remain in a straight position and that either or all of arm segments 47, 49 and 51 can be bent into positions having various configurations and various degrees of curvature.

Figure 6A:
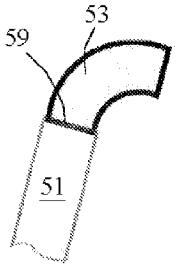
FIGS. 6A-6C illustrate various aspects of a deformable portion of a dispenser arm according to the invention.
Figure 6B:
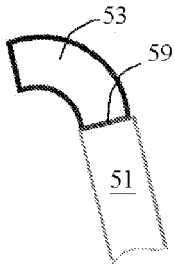
Figure 6C:
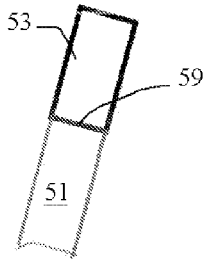

For example, FIGS. 6A-6C illustrate arm segment 53 bent into various shapes: FIG. 6A shows arm segment 53 generally bent to the right with respect to adjacent arm section 51; FIG. 6B shows arm segment 53 generally bent to the left with respect to adjacent arm segment 51; and FIG. 6C shows arm segment 53 positioned generally straight, i.e. aligned coaxially with respect to arm segment 51.

Now returning to FIG. 3, arm segments 47, 49, 51 and 53 can be formed of a resiliently bendable material such as Teflon or other suitable materials and may be generally tubular in shape according to one exemplary embodiment. The resiliently bendable materials may include a stiffening element such as a metal wire, a plurality of metal wires, or a metal mesh, for example: The stiffening element is capable of being deformed and retaining its deformed shape after a deforming force is removed. According to one exemplary embodiment, arm segments 47, 49, 51 and 53 may be formed of a bendable material such as Teflon and the stiffening element may be included inside the inner and outer walls or the Teflon or other bendable material. According to other exemplary embodiments in which the bendable material such as Teflon is in the form of a tube, the stiffening elements such as a wire mesh may be circumferentially surround the tube that forms arm segments 47, 49, 51 or 53. In this manner, the slurry flows within a tube formed of the material such as Teflon with the stiffening element disposed outside the outer diameter and outer surface of the bendable material. Dispenser arm 45 may have an inner diameter that increases or decreases along the direction toward the distal dispenser head 63.

Dispenser head 63 includes a plurality of dispenser ports 65 which are underside the dispenser arm 63 and are illustrated as visible from above to illustrate exemplary positions thereof. Dispenser head 63 is formed of multiple head segments 73, 75, 77. Dispenser head 63 is arcuate in shape and is also a telescoping member, expandable and collapsible along the arcuate direction indicated by arrows 70. In one exemplary embodiment, dispenser head may be similar to dispenser arm 45 in that head segments 73, 75, 77 may be slidably nested within one another and received at intersections 68. Although three head segments 73, 75, 77 are illustrated in FIG. 3, such is exemplary only and there may be more or fewer head segments in other exemplary embodiments. According to the illustrated embodiment, the arcuately shaped dispenser head 63 may be semicircular but other arcuate or annular shapes may be provided in other exemplary embodiments. Compared to the illustrated arrangement shown in FIG. 3 in which dispenser head extends circumferentially around an arc of about 180 degrees, dispenser head 63 may be expanded to a greater span or contracted to a lesser span. As dispenser head 63 is expanded or contracted, the number of available dispenser ports 65 will vary. Dispenser head 63 may be tubular in cross-sectional shape in one exemplary embodiment. Various conventional nozzles or other fluid dispensing structures may be used at dispenser ports 65.

Figure 7A:
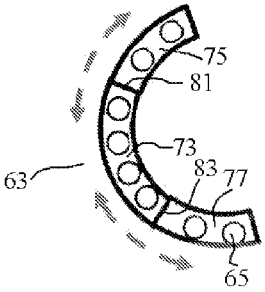
FIGS. 7A-7C illustrate various aspects of an exemplary dispenser head according to the invention.
Figure 7B:
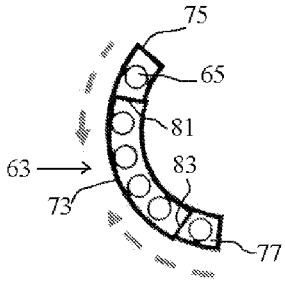
Figure 7C:
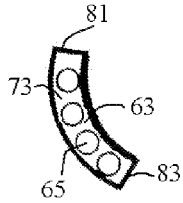

Now referring to FIGS. 7A-7C, three different arrangements of dispenser head 63 are shown. In the embodiment illustrated in FIG. 7A, dispenser head 63 includes eight dispenser heads 65 and extends circumferentially about 180 degrees. FIG. 7B shows dispenser head 63 after outer head segments 75 and 77 have been slid inwardly with respect to head segment 73 thereby producing dispenser head 63 with six dispenser ports 65 and extending about 110 degrees. FIG. 7C shows dispenser head 63 after head segments 75 and 77 have been completely received within head segment 73 to produce dispenser head 63 having four dispenser ports 65 and extending only about 70 degrees. The arrangements shown in FIGS. 7A-7C are intended to be exemplary only and other configurations are available in other exemplary embodiments.

Returning to FIG. 3, each of head segments 73, 75 and 77 may be formed of various suitable materials. According to one exemplary embodiment, head segments 73, 75, 77 may be formed of a deformable material such as described in conjunction with arm segments 47, 49, 51 and 53. As such, head segments 73, 75, 77 may be bendable, i.e. deformable and capable of retaining their deformed shape after a deforming force is removed. As such, dispenser head 63 may take on various different configurations and may be deformed to include various degrees of curvature. According to one exemplary embodiment, dispenser head 63 may be configured to include the same radius of curvature as the semiconductor wafer to be polished on the polishing pad.

In view of the deformability and telescoping nature of both dispenser arm 45 and dispenser head 63 and the pivotability of dispenser arm 45 about pivot point 46, it can be appreciated that dispenser head 63 can be positioned at virtually any location over polishing pad 33 and may include any of various numbers of dispenser ports 65. In this manner, the slurry may be dispensed at the location that most effectively results in the slurry being efficiently delivered throughout the wafer polishing location.

Figure 4:
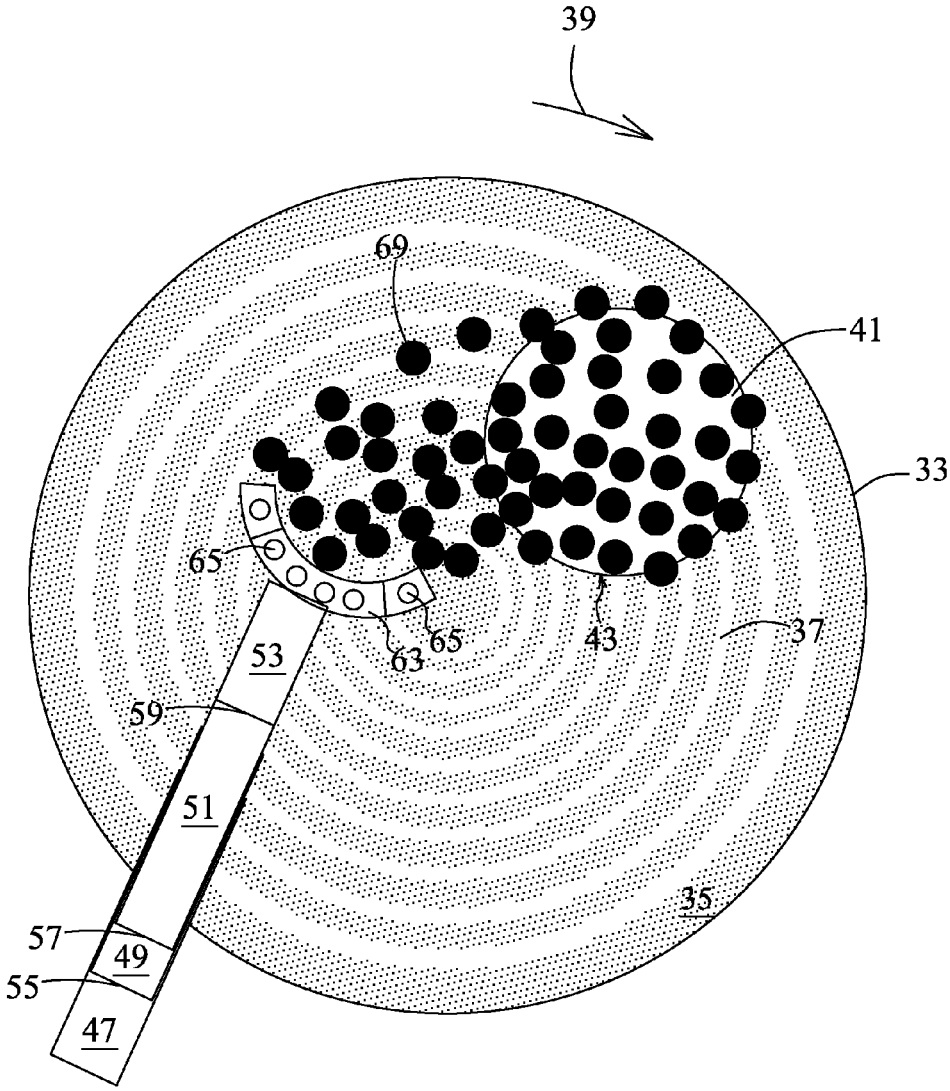
FIG. 4 is a plan view showing another exemplary embodiment of a CMP apparatus according to the invention.

FIG. 4 shows an example of dispenser arm 45 deformed to include a different configuration than dispenser arm 45 shown in FIG. 3. In FIG. 4, each of arm segments 47, 49, 51 and 53 are substantially coaxial and straight and dispenser head 63 has been collapsed slightly with respect to the configuration shown in FIG. 3 and now includes six dispenser ports 65. It can be seen that slurry 69 is delivered so that it completely covers polishing location 43. It should be emphasized that wafer outline 41 represents the position of a wafer at polishing position 43 and with slurry 69 covering wafer outline 41, it should be understood that the slurry is delivered and completely spread throughout polishing location 43, and therefore disposed between polishing pad 33 and a wafer positioned on polishing pad 33 at polishing location 43. With slurry 69 distributed throughout polishing location 43, a uniform polishing profile is achieved and little slurry is wasted.

Figure 5A:
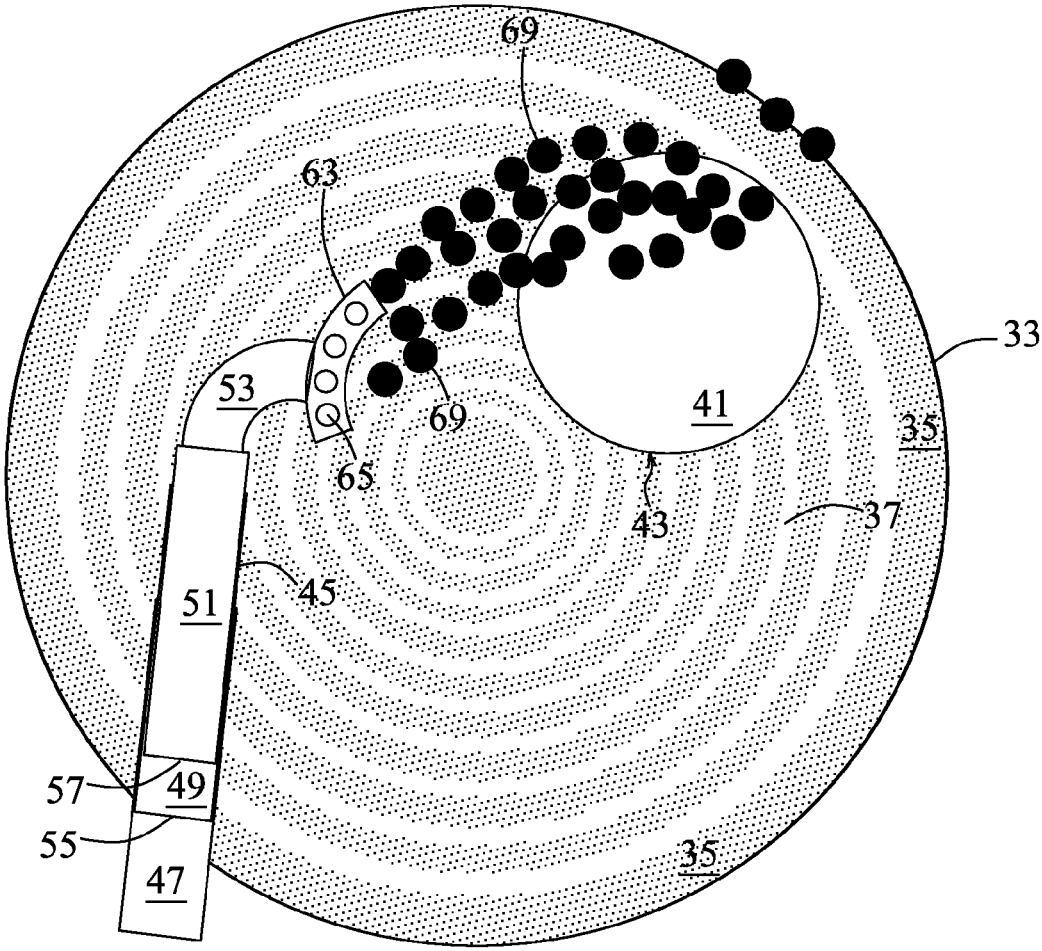
FIG. 5A is a plan view showing another exemplary embodiment of a CMP apparatus according to the invention and FIG. 5B is a graphical representation of a removal profile associated with the arrangement of FIG. 5A.
Figure 5B:
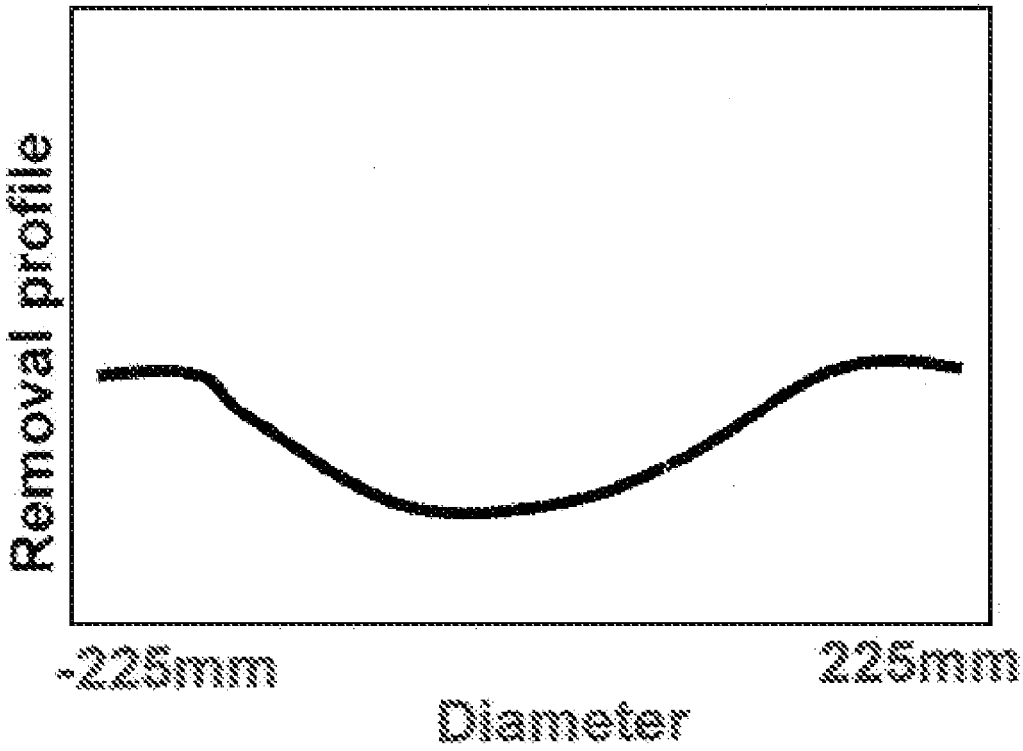

FIG. 5A shows another exemplary arrangement in which dispenser arm 45 is contracted with respect to the arrangement shown in FIG. 3 and in which dispenser head 63 has been contracted to include only four dispenser ports 65. It can be seen that slurry 69 is effectively delivered only to outer portions of polishing location 43 as represented by wafer outline 41. According to this exemplary arrangement, the removal rate at the outer portions of a wafer is uniformly higher than the removal rate at interior portions of a wafer. This is illustrated graphically in FIG. 5B which shows a comparatively fast edge removable rate for an exemplary 500 mm wafer.

The invention also provides a method for polishing that provides for adjusting the location and/or the number of dispense ports to accommodate different sized wafers and/or polishing pads. A CMP apparatus is provided that includes a polishing pad and a slurry dispenser including a dispenser arm and dispenser head as previously described. Initially, the dispenser arm may have a first configuration and a first wafer is provided on the polishing pad. Slurry is dispensed with the dispenser head at a first dispense location, the dispenser arm having a first configuration and the dispenser head including a first arrangement. After polishing the first wafer, the dispenser head may be moved to a second location different than the first location. This may be carried out by at least one of expanding, collapsing or bending the dispenser arm, expanding, collapsing or bending the dispenser head. The number of dispensing ports may also be varied. As such, the dispenser head may be at a different location. The dispenser head may be configured in a different arrangement and the dispenser arm may now have a second deformed configuration different from the first configuration. With the dispenser head at a second location, the wafer is then polished by dispensing slurry from the dispenser head.

The dispenser head finds application in CMP tools used to polish 200 mm, 300 mm and 450 mm or any other size wafers. Differently sized wafers may be delivered to different tools. According to one exemplary embodiment, the different CMP polishing tools include differently sized polishing pads and according to another embodiment, both the wafer size and the polishing pad size are different. In each case, the dispenser head may be positioned at one or more locations as described above, and the wafer polished by dispensing slurry from the dispenser head.

In this manner, in each exemplary polishing operation, a sufficient amount of polishing slurry is efficiently delivered to the entirety of the polishing location of the particular wafer size on the particular polishing pad.

Figure 1A:
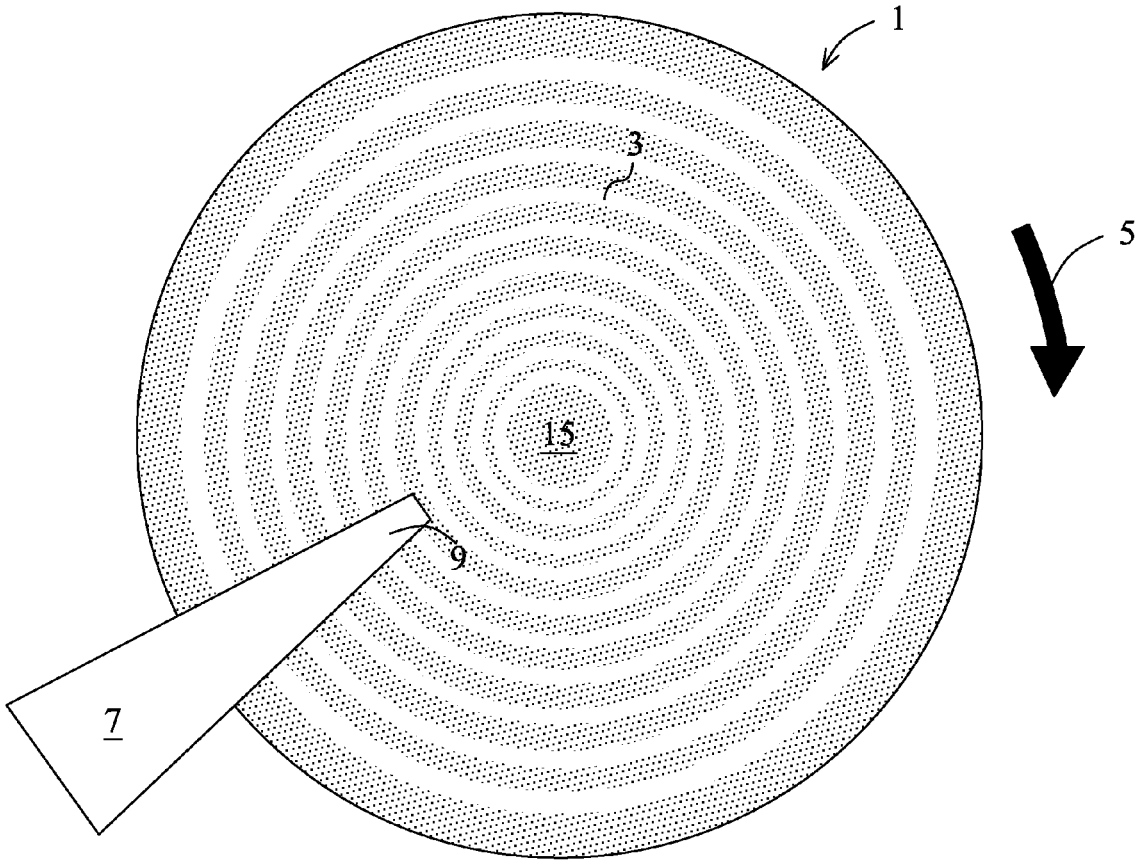
Fig. 1A (Prior Art)
FIGS. 1A and 1B are plan and side views, respectively, of a conventional CMP apparatus according to the PRIOR ART.
Figure 1B:
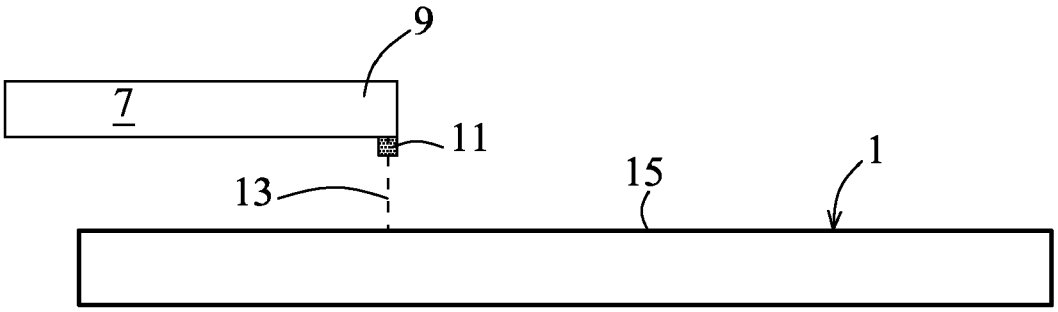
Fig. 1B (Prior Art)
Figure 2A:
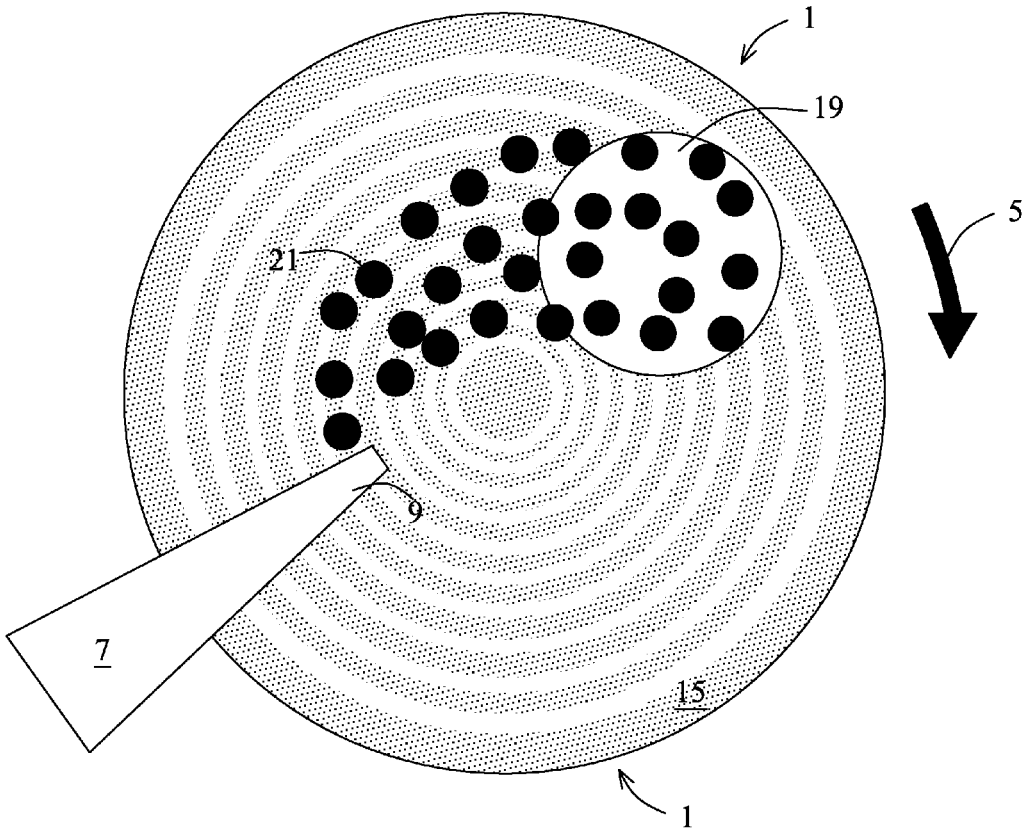
Fig. 2A (Prior Art)
FIGS. 2A and 2B are plan views illustrating one of the shortcomings associated with conventional CMP polishing tools as in the PRIOR ART.
Figure 2B:
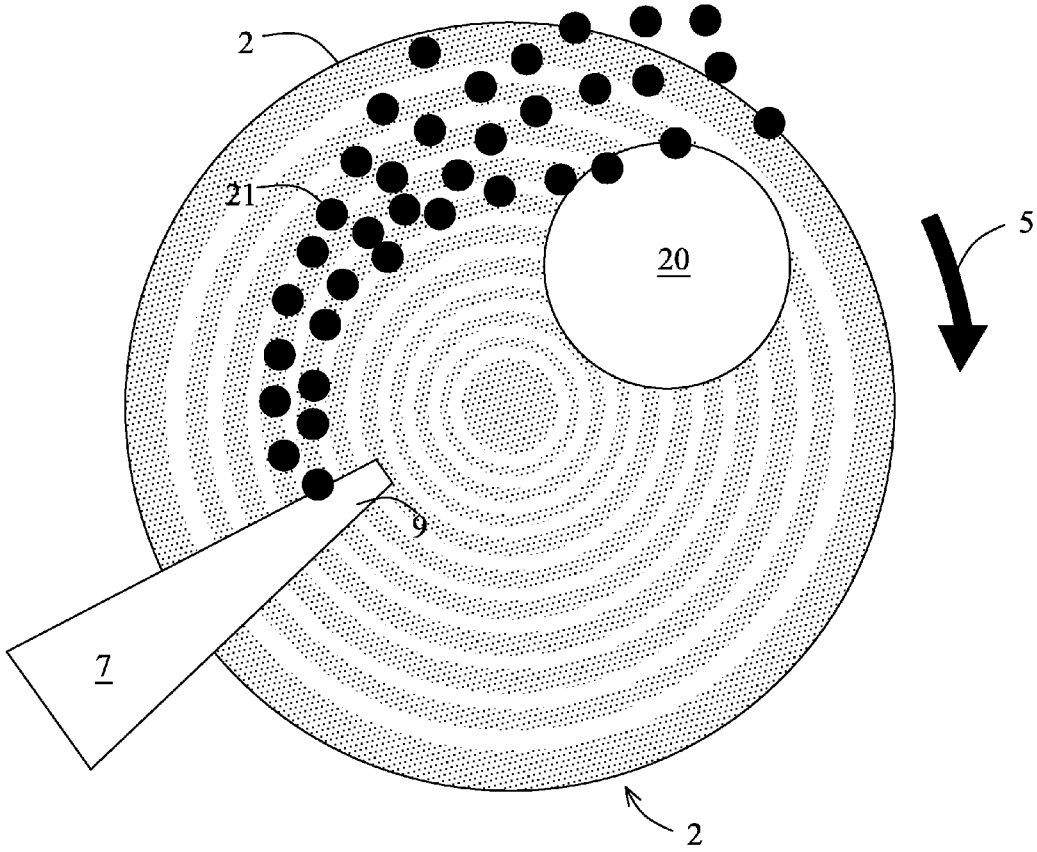
Fig. 2B (Prior Art)

Although FIGS. 3-5A are each drawn to illustrate a similarly sized polishing pad and wafer size as indicated by wafer outline 41, it should be understood that the inventive slurry dispenser can be used with various polishing pad 33 sizes, i.e. when polishing pad 33 is changed and replaced by a larger or smaller polishing pad and when various sizes of wafers are used such as indicated in FIGS. 2A and 2B. It should be also understood that the polishing location 43 may be changed and that dispenser arm 43 and dispenser head 63 may be moved or reconfigured to accommodate the new polishing location. It should be understood that the deformability of arm segment 53 as illustrated in FIGS. 6A-6C is a characteristic that also applies to each of head segments 73, 75 and 77.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A chemical mechanical polishing (CMP) apparatus comprising a polishing pad and a slurry dispenser that dispenses slurry onto said polishing pad, said slurry dispenser comprising a dispenser arm coupled to an arcuate dispenser head having a plurality of dispense ports therein, said dispenser arm being a telescoping arm that is pivotable about a pivot point and deformable and capable of retaining a deformed configuration, wherein said arcuate dispenser head is arcurately expandable and collapsible to change a number of open dispense ports of said plurality of dispense ports.

2. The CMP apparatus as in claim 1, wherein said arcuate dispenser head has substantially a curvature of a circle with a diameter of about 450mm or about 300mm.

3. The CMP apparatus as in claim 1, wherein said arcuate dispenser head has substantially a curvature of a circle and is capable of expanding from a circumference of about 20° to about 180°.

4. The CMP apparatus as in claim 1, wherein said arcuate dispenser head is tubular in cross-sectional shape.

5. The CMP apparatus as in claim 1, wherein said dispenser arm further includes further dispense ports therein.

6. The CMP apparatus as in claim 1, wherein said dispenser arm is formed of a plurality of segments, each segment slidably nested within an adjacent one of said segments.

7. The CMP apparatus as in claim 1, wherein said dispenser arm is formed of a flexible, resilient material including a deformable stiffening element that can be repeatedly and forcibly deformed while substantially retaining a deformed configuration after removal of a deforming force.

8. The CMP apparatus as in claim 7, wherein said deformable stiffening element is metal.

9. The CMP apparatus as in claim 1, wherein said dispenser arm comprises a plurality of nested segments, a first nested Segment of said nested segments directly coupled to said arcuate dispenser head and formed of a deformable tube having at least a metal wire therein.

10. A chemical mechanical polishing (CMP) apparatus comprising a polishing pad and a slurry dispenser that dispenses slurry onto said polishing pad, said slurry dispenser comprising a dispenser arm coupled to a dispenser head having a plurality of dispense ports therein, said dispenser arm being a telescoping and deformable arm that is pivotable about a pivot point, and said dispenser head being a telescoping and deformable tubular member.

11. The CMP apparatus as in claim 10, wherein said deformable dispenser head is bendable to provide a radius of curvature ranging from at least 300mm to about 450mm.

12. The CMP apparatus as in claim 10, wherein each of said dispenser arm and said dispenser head includes a plurality of segments slidably nested in an adjacent one of said segments.

13. The CMP apparatus as in claim 10, wherein each of said dispenser arm and said dispenser head is formed of a flexible, resilient material including a deformable stiffening element that can be repeatedly and forcibly deformed while substantially retaining a deformed configuration after removal of a deforming force.

14. The CMP apparatus as in claim 13, wherein said deformable stiffening element is metal.

15. A method for chemical mechanical polishing (CMP) of semiconductor wafers, said method comprising:

providing a CMP apparatus comprising polishing pad and a slurry dispenser with a dispenser arm having a first configuration and capable of expanding and collapsing, and an arcuate dispenser head;

providing a first wafer on said polishing pad and dispensing slurry with said arcuate dispenser head at a first dispense location;

polishing said first wafer using slurry dispensed from said arcuate dispenser head at said first location;

moving said arcuate dispenser head to a second location different than said first dispense location by at least one of expanding, collapsing and bending said dispenser arm to produce a second configuration of said dispenser arm;

providing a second wafer on one of said polishing pad and a further polishing pad;

polishing said second wafer using slurry dispensed from said dispenser head at said second location; and further comprising arcuately expanding said arcuate dispenser head.

16. The method as in claim 15, wherein said providing a CMP apparatus includes said dispenser arm being a telescoping member and comprising a plurality of arm segments, each arm segment slidably nested in an adjacent one of said arm segments and wherein said providing a second wafer comprises providing said second wafer on said further polishing pad, said further polishing pad being larger than said polishing pad.

17. A method for chemical mechanical polishing (CMP) of semiconductor wafers, said method comprising:

providing a CMP apparatus comprising a polishing pad and a slurry dispenser with a dispenser arm having a first configuration, and a dispenser head;

providing a first wafer on said polishing pad and dispensing slurry with said dispenser head at a first dispense location;

polishing said first wafer using slurry dispensed from said dispenser head at said first location;

moving said dispenser head to a second location different than said first dispense location by at least one of expanding, collapsing and bending said dispenser arm to produce a second configuration of said dispenser arm;

providing a second wafer on one of said polishing pad and a further polishing pad; and polishing said second wafer using slurry dispensed from said dispenser head at said second location, wherein said dispenser head comprises a plurality of n dispense ports at said first location;

further comprising expanding said dispenser head to produce a plurality of greater than said n dispense ports; and wherein said dispenser head includes said plurality of greater than said n dispenser ports at said second location.

18. The method as in claim 15, wherein said second wafer is larger than said first wafer.

19. The method as in claim 15, wherein said dispenser head is deformable and is capable of substantially retaining a deformed configuration after removal of a deforming force, and wherein said moving further comprises deforming said dispenser head.

* * * * *